United States Patent [19]

Walker

[11] 4,103,893

[45] Aug. 1, 1978

[54] TRANQUILIZER DART

[75] Inventor: Elijah C. Walker, Takoma Park, Md.

[73] Assignee: The United States of America as represented by the Department of Health, Education and Welfare, Washington, D.C.

[21] Appl. No.: 805,567

[22] Filed: Jun. 10, 1977

[51] Int. Cl.[2] ..... A61D 7/00

[52] U.S. Cl. ..... 273/106.5 D; 128/218 R

[58] Field of Search ..... 273/106.5 D; 128/218 R, 128/218 A, 216

[56] References Cited

U.S. PATENT DOCUMENTS

| | | | |
|---|---|---|---|
| 1,541,615 | 6/1925 | Bessesen | 128/218 R |
| 2,699,167 | 1/1955 | Raiche | 273/106.5 D X |
| 3,207,157 | 9/1965 | Murdoch | 273/106.5 D X |
| 3,359,979 | 12/1967 | Murdoch | 273/106.5 D X |
| 3,396,660 | 8/1968 | Bilson et al. | 128/218 R X |

*Primary Examiner*—Paul E. Shapiro
*Attorney, Agent, or Firm*—Browdy & Neimark

[57] ABSTRACT

A tranquilizer dart for injecting a tranquilizing liquid into an animal consists of a cylindrical chamber with a tapered forward end provided with a pointed hollow needle. A conical valve bears against an annular seat in the chamber and has a triggering pin extending through the needle and normally projecting forwardly beyond its point. Tranquilizer liquid is contained in the chamber between the valve and a front plunger. A rear plunger is provided in the rear end of the chamber, and rearward movement thereof is limited by an insertable stop pin. The rear plunger serves, on loading, to compress the air between itself and the front plunger. Responsive to impact, the triggering pin is pushed back, unseating the conical valve, and the compressed air forces the front plunger forward, thus injecting the liquid into the animal.

10 Claims, 3 Drawing Figures

TRANQUILIZER DART

FIELD OF THE INVENTION

This invention relates to projectiles for the delivery of drugs to animals, and more particularly to a lightweight dart which can be propelled from a blowgun, or equivalent propelling means, and which upon impact with an animal, can inject a tranquilizing liquid into the animal for subduing the animal.

BACKGROUND OF THE INVENTION

Various types of projectiles which can be fired at an animal from a distance and which can inject a liquid drug into the animal have been proposed. These projectiles usually are provided with relatively complicated triggering mechanisms for releasing the liquid drugs after impact, and also usually include a considerable amount of additional mechanisms, thereby making the projectiles heavy and cumbersome. In most of these prior-proposed projectiles, the weight of the projectile is so great that it cannot be fired accurately from a distance unless propelled by a cartridge using a chemical explosive. This involves generation of considerable noise, which frightens the animal and causes undesired movement thereof, frequently resulting in a miss. Also, other nearby animals are disturbed and usually run off, removing further opportunity of capturing a desirable specimen.

It is therefore usually desirable to use a noiseless propelling means, such as a blowgun, or the like, which is of simple construction and can be operated merely by lung power.

Examples of previously-proposed projectiles, techniques, and propulsion devices are disclosed in the following prior U.S. patents and the cited publication given herewith:

| | |
|---|---|
| Hollingsworth, | 3,893,866 |
| Crockford et al, | 2,854,925 |
| Gregory, | 3,042,406 |
| Gesick et al, | 3,006,649 |
| Cox, | 2,995,373 |
| Palmer, | 3,701,533 |
| Van Horn et al | 2,617,359 |

Brockelman & Kobayshi: "Live Capture of Free-Ranging Primates with a Blowgun", Journal of Wildlife Management, Vol. 35, No. 4, Oct. 1971, pp. 852–855.

SUMMARY OF THE INVENTION

Accordingly, an object of the present invention is to overcome deficiencies in the prior art, such as pointed out above.

Another object is to provide for the improved live capture of animals.

An additional object is to provide a novel and improved tranquilizer dart for injecting a tranquilizing liquid into an animal, free of above-named deficiencies.

A further object of the invention is to provide a tranquilizer dart which is light in weight and which can be accurately propelled from a distance, using a blowgun or an equivalent simple and noiseless propulsion device.

A still further object of the invention is to provide an improved tranquilizer dart which is simple in construction, which can be accurately propelled for a substantial range from a blowgun by lung power, which employs only a few parts, which minimizes the amount of mechanism necessary to deliver the tranquilizing liquid on impact, which has a positive-acting release mechanism, which is easy to reload, and which is compact in size.

A still further object of the invention is to provide an improved tranquilizer dart which utilizes compressed air for release of the tranquilizing liquid, the air being previously placed under pressure by the loading of the dart, and the release of the tranquilizing liquid being accomplished automatically by the impact of the dart with an animal.

BRIEF DESCRIPTION OF THE DRAWINGS

Further objects and advantages of the invention will become apparent from the following description of an embodiment, and from the accompanying drawings, wherein.

DESCRIPTION OF A PREFERRED EMBODIMENT

Figure 1:
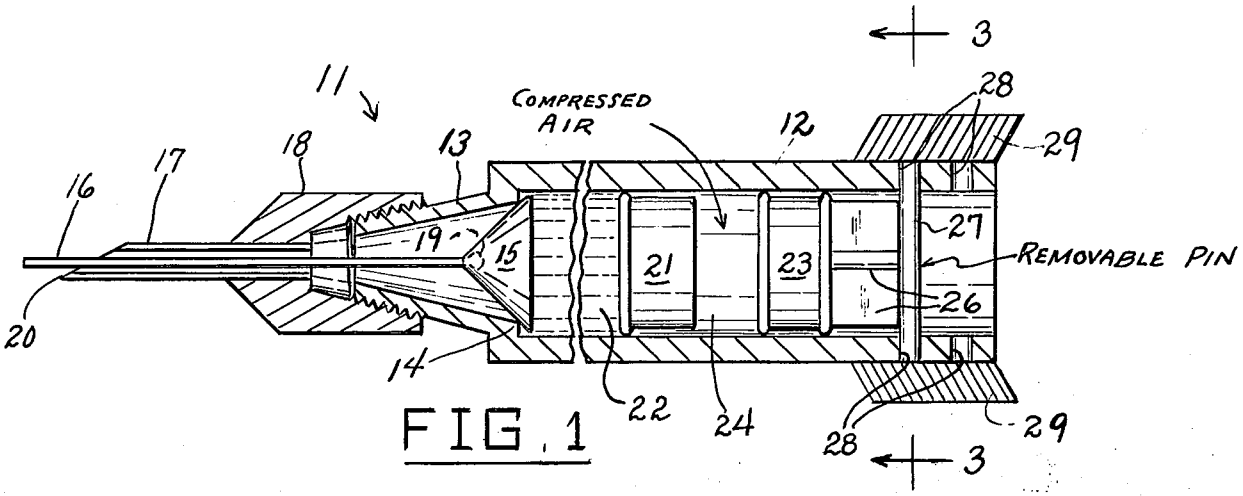
FIG. 1 is a longitudinal vertical cross-sectional view of an improved tranquilizer dart constructed in accordance with the present invention, shown in loaded condition ready for use.
Figure 3:
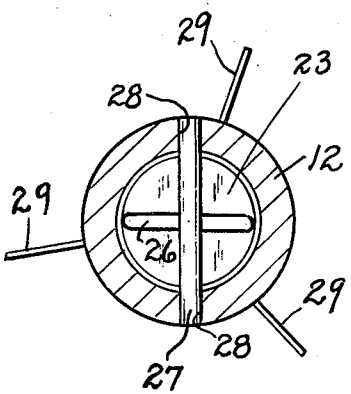
FIG. 3 is a transverse vertical cross-sectional view taken substantially on the line 3—3 of FIG. 1.

Referring to the drawings, 11 generally designates a fully assembled tranquilizer dart according to the present invention. The dart 11 comprises a main barrel 12 of generally cylindrical shape having a reduced forwardly tapering, frusto-conical front end portion 13 defining an inner annular shoulder 14 which functions as a valve seat for a conical valve element 15 disposed in said main barrel. The conical valve element 15 has a triggering pin 16 rigidly secured to its apex and extending forwardly therefrom through a hollow hypodermic needle 17 provided with a supporting hub portion 18 which is rigidly coaxially secured on the tapered portion 13 in any suitable manner, for example, by being threadedly engaged or press fitted therewith, as shown.

Pin 16 is of rigid material, e.g. metal or rigid plastic, and may be secured axially in any suitable manner to the apex of conical valve 15. For example, pin 16 may comprise a 0.017" O.D. hypo tube formed at one end with a small bead 19 of metal which is molded into the apex portion of the conical valve element 15, the latter being molded from a yieldable material, e.g. silicone (Silastic), or the like. The bead 19 absorbs the force acting on the silicone cone 15 when the triggering pin system is placed under pressure.

As shown in FIG. 1, the pin 16 is of a length sufficient to project a substantial distance forwardly from the point 20 of hollow needle 17 when conical valve 15 is seated against annular shoulder 14.

The hollow needle assembly may comprise a No. 20 hypodermic needle 17 with an aluminum hub 18. The barrel 12 may comprise a conventional 1 cc disposable syringe barrel shortened to reduce its weight by an amount depending upon the quantity of tranquilizer or drug desired to be injected into an animal. The components may be formed of any suitably strong and inert materials, preferably lightweight.

Slidably and sealingly disposed in the barrel 12 is a front plunger 21, intended to confine the liquid tranquilizer or drug, shown at 22, and to exert forward pressure thereon to cause the liquid material 22 to be discharged from the hollow needle when conical valve 15 is unseated, as will be presently described.

Designated at 23 is a rear plunger, slidably and sealingly disposed in barrel 12 and defining an air space 24 with respect to front plunger 21. In loading the dart, the rear plunger 23 acts to compress the air in space 24.

The plunger 23 may be provided with rearwardly projecting stems constituting evenly spaced radial guide vanes 26 which bear against an insertable containment pin 27 extending through diametrically opposed apertures 28, 28 in the rear end portion of barrel 12. Pin 27 serves to contain the pressurized system by acting as a stop for the rear plunger 23. To allow for various degrees of pressurization more than one set of diametrically opposed apertures can be provided.

Suitably secured to the rear end of barrel 12, as by means of rubber contact cement or other suitable adhesive, are a plurality of evenly spaced, radially extending guide fins 29, which may comprise feathers such as are employed in arrow making. Of course, suitable guidance fins may be formed of other materials as well. When the dart is employed under laboratory conditions, fins 29 may be omitted.

To prepare the dart 11 for use, the following sequence may be followed:

a. The triggering pin assembly 15, 16 is placed in the syringe barrel 12 with pin 16 extending through hollow needle 17.

b. The front plunger 21 is placed in the barrel at a position determined by the quantity of liquid 22 to be injected, i.e., if 1 cc is to be injected, the plunger 21 is placed at a position suitably marked for 1 cc.

c. Using another syringe, the desired amount of liquid 22 is injected into the barrel 12 through the hollow needle 17, making sure that all air bubbles are removed.

d. While firmly holding pin 16 with one hand so that conical valve 15 is sealingly seated against annular shoulder 14, rear plunger 23 is inserted and is pushed inwardly to a pressurizing position, using the other hand. Triggering pin 16 may be released after sufficient pressure is developed in the barrel space 24 to hold valve 15 in seated sealing position. Inward pushing force on rear plunger 23 is continued (compressing the air in space 24) until the containment pin can be inserted through the apertures 28, 28 behind the stem of the plunger 23.

e. Containment pin 27 is then inserted through the holes 28, 28, thus locking rear plunger 23 in pressurizing position.

The dart 11 is launched by placing it in the rear end of a blowgun and placing a wad of cotton immediately behind it. The operator can then propel the dart from the blowgun by forcefully exhaling at the rear end of the blowgun.

Figure 2:
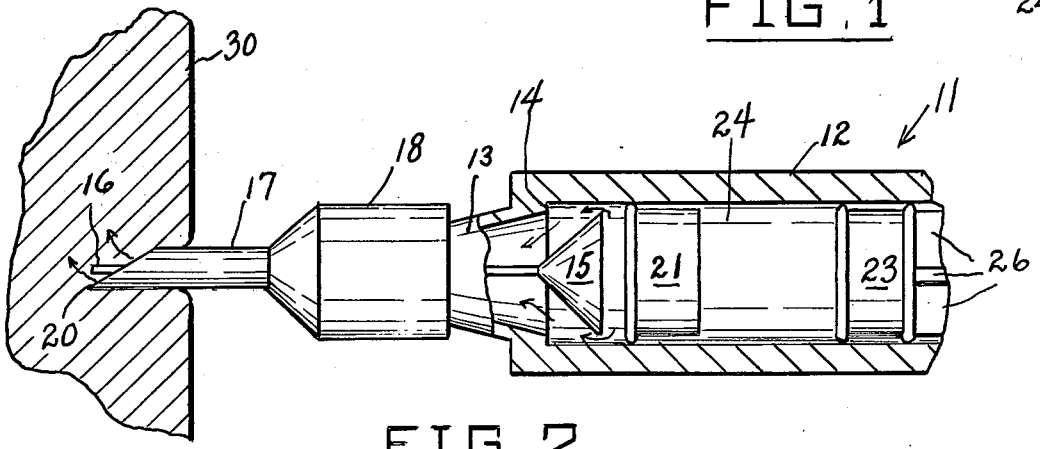
FIG. 2 is a fragmentary vertical cross-sectional view similar to FIG. 1, but showing how the tranquilizer liquid release valve of the dart is automatically opened responsive to impact with an animal.

Upon impact with the target (the animal 30 shown in FIG. 2) the triggering pin 16 is pushed back, moving the conical valve 15 rearwardly in the barrel and disengaging it from its annular seat 14. As soon as the conical valve is unseated, the compressed air in space 24 forces the front plunger 21 forwardly, thus injecting the liquid 22 into the animal.

It will thus be seen that the compressed air in space 24 acts like a spring, being first placed in compression by the loading procedure above described, and expanding to exert liquid injection force when conical valve 15 is unseated by the action of the triggering pin 16. Using air as the compression-expansion medium avoids the extra weight which would be introduced by using a spring, and thus improves the accuracy and range of the dart when propelled from a blowgun.

While a specific embodiment of an improved tranquilizer dart has been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. A lightweight projectile dart for injecting liquid into an animal upon impact, comprising:

a barrel having a forward end and a rearward end and being provided at said forward end with a hollow needle, means defining a valve seat in the barrel near said forward end, a valve element sealingly engageable with said seat and movable toward said rearward end to unseat a triggering pin connected to said valve element and extending through said needle and projecting forwardly therefrom when the valve element engages the seat, first movable plunger means in the barrel spaced rearwardly from said valve element and defining a liquid reservoir relative to said valve element, second movable plunger means in the barrel spaced rearwardly from said first movable plunger means defining an air space relative to said first plunger means, and stop means in the barrel located rearwardly of said second movable plunger means and holding the second movable plunger means in a pressurizing position for compressing the air in said air space, whereby the compressed air acts on the first plunger means to force liquid in said reservoir past the valve element when the valve element is unseated by impact of the triggering pin with an animal, said valve seat being communicatively connected with said hollow needle.

2. The dart of claim 1, and wherein said valve seat comprises an annular shoulder in the front portion of the barrel and said valve element comprises a body having an annular surface sealingly engageable with said annular shoulder.

3. The dart of claim 1, and wherein said stop means comprises a transverse pin engaged through the barrel and limiting rearward movement of said second plunger means.

4. The dart of claim 1, and wherein said stop means comprises a stop pin removably engaged transversely through the barrel rearwardly adjacent said second plunger means.

5. The dart of claim 4, and wherein said valve seat comprises an annular shoulder in the front portion of the barrel and said valve element comprises a conical member sealingly engageable with said annular shoulder.

6. The dart of claim 5, and wherein said triggering pin is connected to the apex of said conical member.

7. The dart of claim 6, and wherein said second plunger means is provided with a plurality of radial guide vanes.

8. The dart of claim 7, and wherein said guide vanes extend rearwardly of said second plunger means and are engageable with said stop pin to limit the rearward movement of said second plunger means.

9. The dart of claim 8, and wherein said barrel is substantially cylindrical in shape and the front portion thereof is provided with a forwardly tapering hollow reduced front end member, said annular shoulder being defined by the rear interior end of said front end member.

10. The dart of claim 1, and wherein said stop means comprises adjustable means to permit variation of the axial location of said second plunger means.

* * * * *